US005257449A

United States Patent [19]

Gjerdrum

[11] Patent Number: 5,257,449

[45] Date of Patent: Nov. 2, 1993

[54] METHOD FOR FASTENING BUTTONS TO TEXTILE

[76] Inventor: Mads Gjerdrum, Konventveien 8, N-0377 Oslo 3, Norway

[21] Appl. No.: 842,203

[22] PCT Filed: Sep. 21, 1990

[86] PCT No.: PCT/NO90/00144

§ 371 Date: May 15, 1992

§ 102(e) Date: May 15, 1992

[87] PCT Pub. No.: WO91/04687

PCT Pub. Date: Apr. 18, 1991

[30] Foreign Application Priority Data

Sep. 26, 1989 [NO] Norway ..... 893827

[51] Int. Cl.[5] ..... B21D 37/02

[52] U.S. Cl. ..... 29/509; 227/82

[58] Field of Search ..... 29/432.1, 432.2, 509; 24/94, 96, 103; 227/32, 33, 34, 55, 77, 82, 85; 2/265

[56] References Cited

U.S. PATENT DOCUMENTS

| | | | |
|---|---|---|---|
| 312,749 | 2/1885 | Moulton | 227/32 |
| 1,171,640 | 2/1916 | Prentice | 24/96 |
| 1,262,782 | 4/1918 | Harmon . | |
| 1,982,540 | 11/1934 | Reich . | |

FOREIGN PATENT DOCUMENTS

| | | |
|---|---|---|
| 51657 | of 0000 | Fed. Rep. of Germany . |
| 340498 | of 1820 | Fed. Rep. of Germany . |
| 8294 | of 1879 | Fed. Rep. of Germany . |
| 36998 | of 1886 | Fed. Rep. of Germany . |
| 2638041 | of 0000 | Fed. Rep. of Germany . |
| 1114093 | of 1954 | France . |
| 10109 | of 0000 | Norway . |

*Primary Examiner*—Timothy V. Eley
*Assistant Examiner*—Kenneth J. Hansen

[57] ABSTRACT

A method and an apparatus is described for fastening buttons to a textile fabric or the like, with the fastening threads (1) being collected to form a thin bundle beneath said button before said bundle is forced through the fabric (7), so that after the button (2) is fastened it will sit at a certain distance from the fabric with a thin bundle of threads in the middle. Collection of the fastening threads (1) is achieved by threading them into a standard button (2) and providing the button in holding means (3) of the apparatus, thus, to clamp the threads together by movement of clamping means (4). When the fabric (7) is in place the holding means (3) of the apparatus is urged down towards the contact plate and the collected bundle of fastening threads is forced through the fabric (7), down into the contact plate and is forced around, out and up through the fabric again and in towards its own axis. The apparatus is removed and the button is fastened.

1 Claim, 2 Drawing Sheets

METHOD FOR FASTENING BUTTONS TO TEXTILE

The present invention relates to fastening buttons in a time saving and more permanent manner. This is especially useful for rapid fastening of buttons which have fallen off a garment.

People often feel that it is uphill work to be obliged to fetch a needle and thread to fasten a button which has fallen off a garment. To many persons the task of threading a needle is quite impracticable. This especially concerns weak-sighted persons as well as old people. Consequently, many garments stay untouched in the closets, or are even thrown away, because they lack buttons and the task of fastening them appears to be too cumbersome and time consuming.

It is an object of the present invention to simplify this task and render it more efficient, and to provide a method of fastening buttons and an apparatus for such an application, which will solve the above problems.

This object is achieved by the method and the apparatus which are characterized by the features stated in the claims.

It is known that buttons may be fastened to a substrate by the aid of rigid threads, e.g. pins, plastic threads, or the like. The new concept of this invention is that the button is fastened by a flexible and, at the same time, rigid thread, so that said thread will remain at a certain distance from the substrate to permit the textile fabric portion with the button hole to be readily buttoned and then to move freely about the button.

This invention is essentially different from other known techniques in that all four attachment threads for buttons are collected into a thin bundle on the underside of the button before the fastening threads pass through the fabric, so that a larger area of the button contributes to hold it in the button hole. The button hole will consequently enclose the collected fastening threads or pin of the button more tightly and closer to the centre of the button. This will result in a reduced hazard of the button slipping out of the button hole again; the buttoned state is, thus, more stable. At the same time there will be less wear of the button hole.

The fastening thread, which may be a plastic covered or finished metal thread or the like, may preferably be designed to be adapted to the holes which are present in standard buttons. This invention, thus, does not require use of special buttons, but may be used for standard buttons on the market. Furthermore, the fastening means is at the end designed to pass readily through the textile fabric, both down through the fabric and up through the fabric upon being curved in the bottom of the device.

By using the invention, it will be possible to fasten the button by the aid of various suitable means, both in a manual and in an automatic manner.

The invention also relates to an apparatus for fastening the button onto the substrate, which differs essentially from any other known technique by fastening the button rapidly to the substrate without use of a needle, a sewing thread, or any kind of loose pieces to be attached on the underside.

It is also an advantageous feature that the apparatus for fastening the button on the substrate is designed in such a manner that it may be held and used by hand. In this connection it is especially useful for fastening buttons which fell off after the garment had been used for some time. The invention represents an essential novelty considering the time spent for fastening a button by other known methods.

The invention is disclosed below with reference to the drawing, in which the fastening method and an apparatus for use with said method are illustrated. In the drawing.

Figure 1:
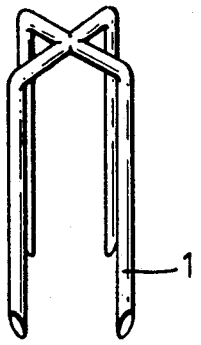
FIG. 1 shows the fastening thread 1 designed with four legs pointing downwards.
Figure 2:
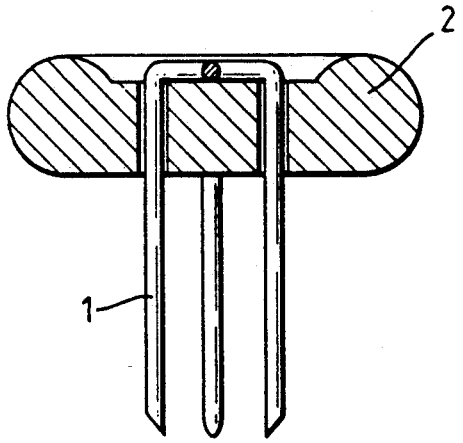
FIG. 2 shows the fastening thread 1 when threaded in place through the holes of a button 2.
Figure 3:
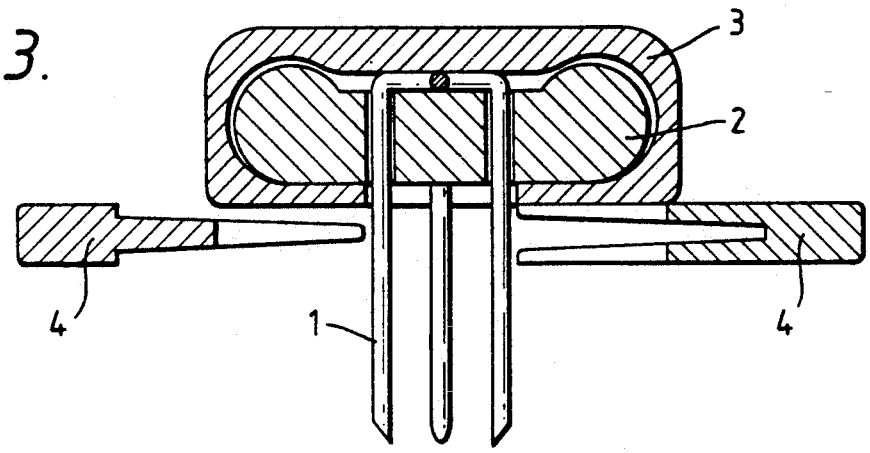
Figure 4:
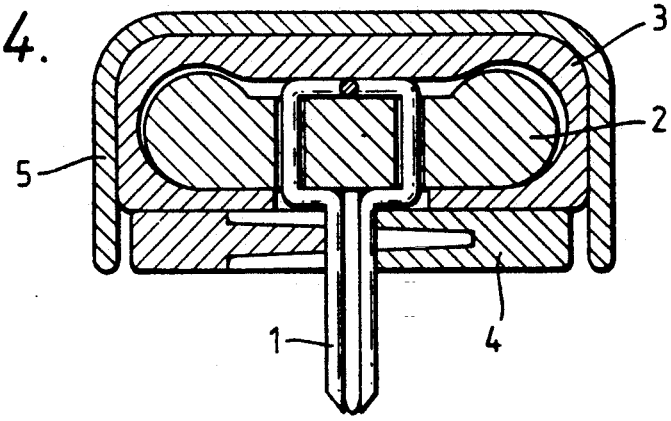
Figure 4:
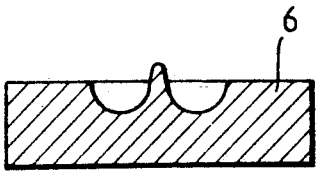
Figure 5:
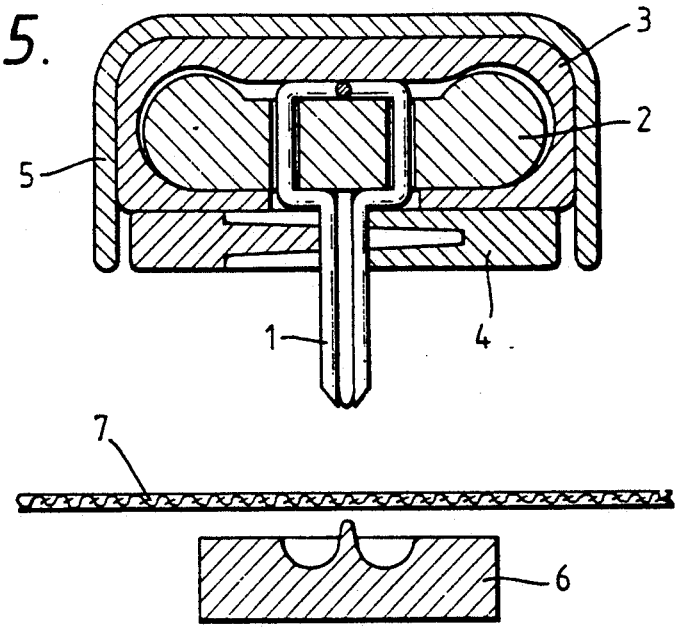
Figure 6:
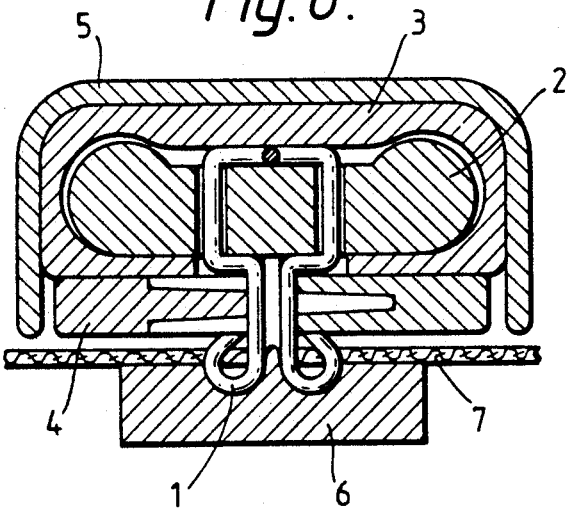
Figure 7:
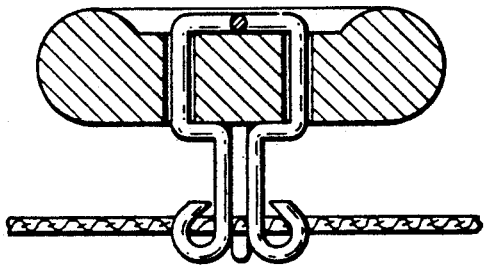
Figure 8:
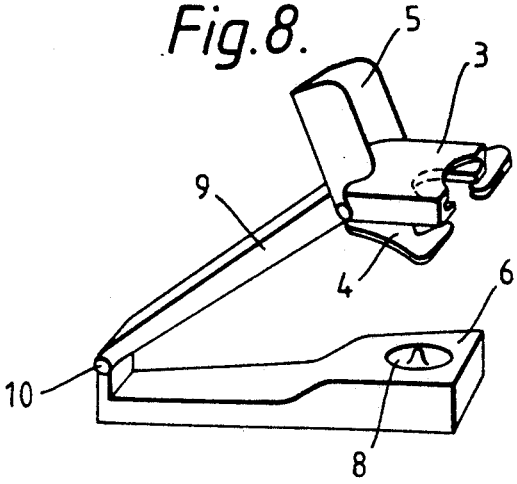

FIG. 3 shows button 2 with fastening thread 1 provided in holder means 3 of the apparatus, with the clamping means of the apparatus in an open state;

FIG. 4 shows clamping means (4) in a clamped state due to the fact that the cover of the apparatus is closed, and that the legs of fastening thread 1 are clamped together to form a thin bundle. The Figure also shows contact plate 6;

FIG. 5 shows that the textile fabric 7 is placed in the apparatus, for the rest this Figure corresponds to FIG. 4;

FIG. 6 shows that holding means 3 of the apparatus is urged towards contact plate 6. Also the pins of fastening threads 1 are forced down through the textile fabric (7), down and around recess 8 of the contact plate, up through fabric 7 again and around towards their own axis;

FIG. 7 shows the fastened button upon removal of the apparatus;

FIG. 8 shows the apparatus proper when it is designed with a holding means 3, a cover 5, a clamping means 4, a contact plate 6, a recess 8 in the clamping plate, and hinge means 10.

The operation of the apparatus is such that when the fastening thread 1 is threaded into the holes of the button and the latter is placed in the holder means 3 of the apparatus, all four legs of the fastening thread 1 are clamped by clamping means 4 of the apparatus to form a thin bundle. Then the textile fabric 7 is positioned across contact plate 6, and legs 1 of the fastening thread in a state in which they are collected into a bundle are forced eown through the fabric 7, down and about the recess 8 of the contact plate, up through the fabric 7 again and about the bundle axis, as a consequence of the holding means 3 of the apparatus being clamped down towards the contact plate 6, e.g. by hand power which is transmitted, via arm 9 and hinge 10.

The method according to the invention involves the essential novelty that buttons may be produced with fastening thread 1 forming an integral part of the button and, e.g. being moulded onto the button. The invention, thus, permits production of a new assortment of buttons which may make use of the new and rapid fastening technique. This will be especially useful in industrial manufacture of clothes in which fastening of buttons is part of the process of manufacture.

I claim:

1. Method for fastening buttons onto a textile fabric by the use of a pin having a body portion and at least two legs extending from said body portion at substantially a right angle thereto comprising, threading said pin legs through openings in a button, clamping said pin legs tightly together to form a straight bundle, forcing said pin legs through a textile fabric layer, bending the ends of said pin legs out and away from said bundle, passing said ends of said pin legs back through the textile fabric layer, and then directing each of said ends of said pin legs toward said bundle.

* * * * *